United States Patent [19]

Platt

[11] 4,154,889

[45] May 15, 1979

[54] NONWOVEN FABRIC, METHOD AND APPARATUS FOR IT'S MANUFACTURE

[75] Inventor: Louis Platt, Seneca, S.C.

[73] Assignee: Phillips Petroleum Company, Bartlesville, Okla.

[21] Appl. No.: 713,002

[22] Filed: Aug. 9, 1976

Related U.S. Application Data

[63] Continuation of Ser. No. 498,777, Aug. 19, 1974, abandoned.

[51] Int. Cl.[2] ..... B32B 5/02

[52] U.S. Cl. ..... 428/234; 19/258; 19/299; 26/87; 26/97; 28/110; 28/135; 156/148; 156/441; 428/235; 428/300

[58] Field of Search ..... 156/148, 441, 167, 494, 156/180, 495, 181, 324, 229, 555, 296, 582, 306; 428/234, 300, 235; 264/103, 288, 290 R; 28/1 CL, 72 NW, 4 R, 72.2 R; 19/161 R, 258, 161 P; 26/87, 97

[56] References Cited

U.S. PATENT DOCUMENTS

| | | | |
|---|---|---|---|
| 3,303,547 | 2/1967 | Kalwaites | 26/87 |
| 3,535,178 | 10/1970 | Parlin et al. | 156/148 |
| 3,545,442 | 12/1970 | Wicker et al. | 156/148 |
| 3,615,989 | 10/1971 | DePoe | 156/148 |
| 3,765,989 | 10/1973 | Burger | 156/441 |

OTHER PUBLICATIONS

Krupp Maschinenfabrikej "Machinery for the Manufacture of Nonwoven Fabrics", pp. 1-18.

*Primary Examiner*—William A. Powell
*Assistant Examiner*—J. J. Gallagher

[57] ABSTRACT

A nonwoven fabric is produced by forming a batt of fibers which are oriented primarily transverse relative to the direction of movement of the batt, stretching said batt longitudinally relative to the direction of movement of the batt, and needling the stretched batt. Also apparatus suitable for the production of the novel fabric is disclosed.

27 Claims, 4 Drawing Figures

NONWOVEN FABRIC, METHOD AND APPARATUS FOR IT'S MANUFACTURE

This application is a continuation of application Ser. No. 498,777 filed Aug. 19, 1974, now abandoned.

BACKGROUND OF THE INVENTION

The invention relates to nonwoven fabric and to a method and apparatus for the production of same.

Nonwoven fabrics and various methods and apparatus for their production are well known in the art. For example, the original nonwoven fabric, wool felt, is as old as any textile. However, in the last ten to fifteen years, synthetic materials have become very important in the nonwoven industry. One of the more common methods used to produce nonwoven fabrics from a batt of synthetic materials such as polypropylene, involves simply needling the batt, which is well known in the art. The needled batt is frequently bonded on one or both sides subsequent to the needling operation, depending upon the properties desired in the final product. Various bonding techniques are also well known.

There are several ways of producing the batt prior to needling and bonding. The first and simplest method is to place several carding machines (or cards) in series, laying the web produced on each successive card on top of the web produced on the preceding card. This method produces a batt with fibers oriented primarily in the longitudinal (warp) direction and thus the nonwoven fabric has much less dimensional stability in the transverse (fill) direction than in the warp direction. As used herein the term "dimensional stability" means the ability of a nonwoven fabric to resist deformation in the warp and/or fill directions due to stresses experienced by the fabric. Improved dimensional stability is indicated by an increase in tear strength and a decrease in percent elongation.

The second method used to produce a batt is that of crosslapping whereby a batt of suitable weight is built by layering a web from a card back and forth on a moving conveyor, such as a floor apron. The fabric produced by such a card and a crosslapper primarily has fibers crosswise in the finished fabric, thus the nonwoven fabric has much less dimensional stability in the warp direction than in the fill direction. Frequently it is necessary to increase the strength of the batt in the warp direction before the batt will process through the needle loom. The lack of sufficient warp strength to process is particularly acute for nonwoven fabrics having a weight of less than about 5 ounces per square yard. As a result, additional strength is often provided by the use of warp threads which are threads of polyester staple or other suitable material spaced ¼-inch or so apart along the bottom surface of the batt, and running parallel to the warp direction of the batt. Although the use of warp threads has proven to produce a useful product, warp threads, of course, increase the overall cost of the fabric. In addition there is room for improvement of the dimensional stability in the warp direction as compared to the dimensional stability in the fill direction.

A third method used to produce a batt is a combination of the first two methods, that is, laying one or more webs in the warp direction by use of one or more cards and laying one or more additional webs in the fill direction by use of a crosslapper. This method produces a product having a better distribution of dimensional stability between the warp and fill directions; however, the dimensional stability is relatively low and a substantially greater initial investment in equipment is required than with either of the two methods previously described.

Therefore, it is an object of the invention to produce a nonwoven fabric.

Another object of the invention is to produce a nonwoven fabric of synthetic fibers.

Still another object of the invention is to produce a nonwoven fabric of synthetic fibers.

Still another object of the invention is to produce a nonwoven fabric by crosslapping without the use of warp threads.

Still another object of the invention is to produce a nonwoven fabric without the use of warp threads but possessing a relatively high dimensional stability in the warp direction.

Still another object of the invention is to provide apparatus suitable for the production of nonwoven fabrics.

Other objects, aspects and advantages of the present invention will be more apparent to one skilled in the art after studying the specification, drawings and the appended claims.

SUMMARY

Thus, according to the invention a novel nonwoven fabric is produced by forming a batt comprising fibers oriented primarily transverse relative to the direction of movement of the batt, stretching the batt longitudinally relative to the direction of movement of the batt, and needling the stretched batt. Where the desired properties of the final product so dictate a portion of the fibers are bonded to each other at least on one side of the needled batt.

Further according to the invention apparatus is provided suitable for the production of the novel fabric comprising, in combination, a crosslapper for laying a web of fibers to produce a batt; a carrier means to receive the web of fibers and transport the batt; a batt stretching means operated to stretch the batt longitudinally relative to the direction of movement of the batt; and a needle loom positoned to needle punch the stretched batt. When it is desired to bond the final product, bonding means are provided for bonding the fiber of at least one surface of said needled batt.

BRIEF DESCRIPTION OF THE DRAWINGS

To further describe the invention the attached drawings are provided in which.

DETAILED DESCRIPTION OF THE INVENTION

Figure 1:
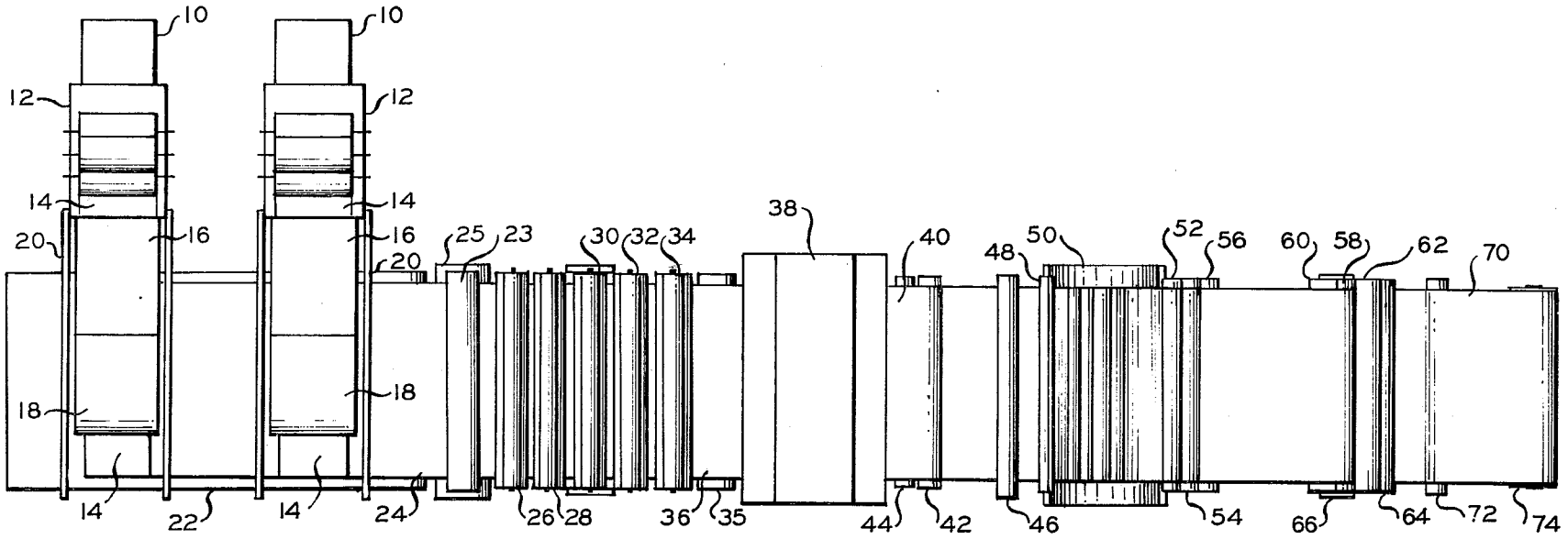
FIG. 1 is the top view of a schematic representation of an embodiment of the apparatus of the invention, including heated rolls for bonding at least one surface of the fabric.
Figure 2:
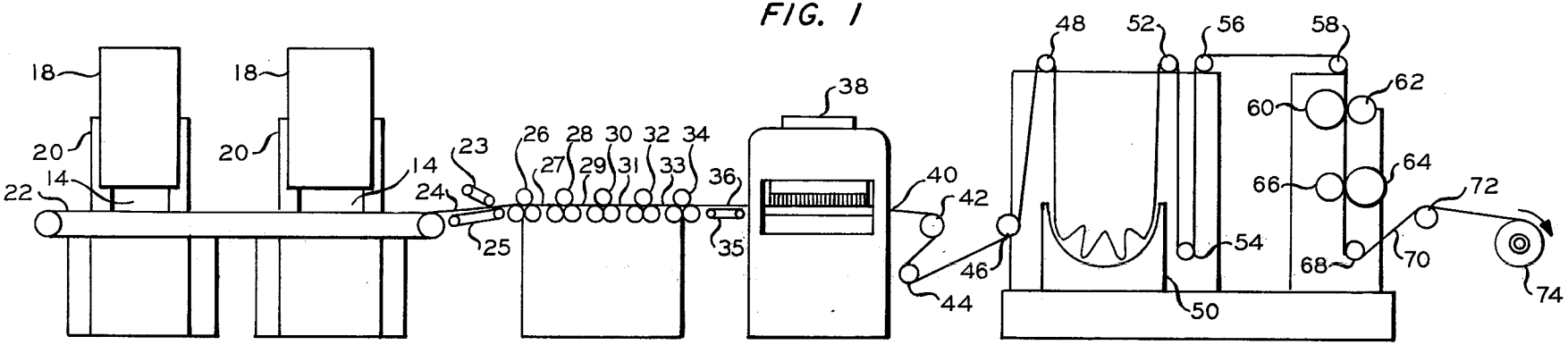
FIG. 2 is an elevational view of the apparatus of FIG. 1.

The apparatus of the invention is more fully understood by referring to the drawings and in particular FIGS. 1 and 2 wherein the embodiment of the apparatus shows a feed means 10, such as bale breakers, blender boxes, feed boxes, etc., which feed fibers in the form of staple to carding machines 12. The carding machines 12 produce carded webs of fibers 14 which are picked up by the take off aprons 16 of crosslappers 20. The crosslappers 20 also comprise lapper aprons 18 which traverse the carrier means, such as floor apron 22, in a reciprocating motion. The carded webs 14 are laid on the floor apron 22 to build up several thicknesses referred to herein as a batt 24. It is pointed out that only one crosslapper 20 and associated equipment need be used to practice the invention; however, two crosslappers are frequently used to increase the speed of the overall operation.

A stretching means comprising at least two sets of nip rolls or an inlet apron 23,25 and one set of nip rolls 26 is used to stretch the batt 24. As used herein the terms stretching, drawing and drafting are synonymous. In FIGS. 1 and 2 five sets of nip rolls are shown, 26, 28, 30, 32 and 34. Inlet apron 23,25 and outlet apron 35 also are shown. Each set of nip rolls is shown as a one-over-two configuration, which works very well, but almost any arrangement can be used, such as a one-over-one, two-over-one, etc., as well as mixtures of nip roll configurations. The stretched batt 36 then is passed to needle loom 38 wherein the batt is needled at a density in the range of 300 to 600 punches per square inch.

The needled batt 40 is passed to a "J" box 50 over rolls 42, 44, 46 and 48 and on to a suitable bonding means, such as heated rolls 60 and 64. Heated rolls 60 and 64 are included in the present description because it is frequently desirable to produce a bonded fabric, but it is emphasized that one can practice the present invention without employing a bonding step or bonding means. The needled batt 50 is passed over additional rolls 52, 54, 56 and 58 as it is passed to heated rolls 60 and 64. The batt is pressed against heated roll 60 by roll 62 to fuse the fibers on the bottom of the batt, and the batt is pressed against heated roll 64 by roll 66 to fuse the fibers on the top of the batt. Either or both heated rolls can be operated as desired or, of course, if rolls 60 and 64 are not heated and unbonded fabric is produced. The batt 70 then is passed over roll 72 and wound on a take-up roll 74.

In the method of the invention, synthetic thermoplastic fibers in the form of staple are passed to carding machines 12 to produce carded webs 14. Various synthetic thermoplastic staple can be used. For example, polyolefins, such as polypropylene, polyesters, such as polyethylene terephthalate, polyamides, such as polycaprolactam (nylon), and mixtures thereof are suitable. The carded webs are laid on the floor apron 18 to produce a batt 24 by crosslappers 20. The batt 24 then is stretched by a suitable means, such as the five sets of nip rolls 26, 28, 30, 32 and 34. When using nip rolls to practice the invention, only two sets of nip rolls actually are required to stretch the batt. The five sets of nip rolls provide for four separate stretching or drafting zones, 27, 29, 31, and 33. Also the batt can be stretched between a nip formed by feed aprons 23,25 and the first set of nip rolls; thus, if an inlet apron 23,25 is used, one can practice the invention by using only one set of nip rolls and the inlet apron to stretch the batt. Of course, the stretching or drafting occurs because each set of nip rolls is operated at a successively higher speed than the speed of the preceding inlet apron or set of nip rolls. Generally, it has been found that utilization of more drafting zones and smaller draft ratios produces a more uniform fabric than utilization of fewer drafting zones with higher draft ratios; however, at some point additional drafting zones will not improve the product. In addition, there is a maximum speed at which the batt at a given weight can be produced due to the limitations of the batt forming equipment. Thus, as in most any process, the most economical operation requires consideration of a number of variables. For example, some of the variables which affect the stretching process are staple material, staple length, staple finish, degree or crimp, weight of batt, etc. Generally from about 2 to 6 drafting zones are utilized with an overall draft ratio ranging from about 1.1 to 3 and a maximum draft ratio per drafting zone of 2.0. However, a very good product is produced utilizing from about 3 to 5 drafting zones with an overall draft ratio ranging from about 1.4 to 2.1 and a maximum draft ratio per drawing zone of 1.5. As used herein the terms "draft ratio" and drafting zone" apply only to the drafting which occurs due to the action of the inlet apron and nip rolls and not the drafting which generally occurs due to the needling operation.

After stretching, the batt is needled using needle loom 38. Generally the needle density is in the range of from about 300 to 600 punches per inch with a needle penetration ranging from about $\frac{1}{4}$ to $\frac{3}{4}$ of an inch. The needled batt 40 is passed over rolls 42, 44, 46 and 48 and into "J" box 50. From "J" box 50 the needled batt is passed over rolls 52, 54, 56 and 58 and then over heated rolls 60 and 64 and pressure rolls 62 and 66. If it is desired to fuse only the bottom side of the batt, then only roll 60 is heated. Likewise, if it is desired to fuse only the top side of the batt, then only roll 64 is heated. Obviously, both rolls 60 and 64 are heated to fuse both sides of the batt. The end use of the fabric generally determines which sides are to be fused. For example, fabric used as primary carpet backing usually has both the top and the bottom surfaces fused whereas a fabric used as a secondary backing usually has only the bottom surface fused. If an unbonded fabric is desired, heated rolls 60 and 64 can be eliminated along with the other associated rolls or heated rolls 60 and 64 can be operated at a temperature below the fusion temperature of the fibers in the batt.

After the fusing operation, the finished fabric 70 is wound on take-up roll 74 after passing over rolls 68 and 72. The fusion temperatures used for synthetic thermoplastic staple, of course, depend upon the particular material used. As an example, for polypropylene staple, fusion roll temperatures range from about 310° to 338° F. where only one surface is fused. If both surfaces are fused, then the temperature of the first fusion roll is the same as above but the temperature of the second fusion roll is somewhat lower and ranges from about 295° to 320° F. However, a good fabric is obtained using a roll temperature ranging from about 320° to 325° F. for a single roll or the first of a two-roll fusion process, and the temperature of the second fusion roll ranging from about 310° to 315° F.

It is believed that the reason the present invention produces a more desirable product than the prior art processes is because the fibers in the batt are partially reoriented toward the warp direction during the stretching step. As mentioned before, laying the batt by crosslapping webs produces a batt with fibers laying primarily in the fill direction. The batt thus formed into a nonwoven fabric without the stretching step has very poor dimensional stability in the warp direction but very good dimensional stability in the fill direction; the direction in which the fibers were primarily oriented when the batt was formed. By stretching the batt in the warp direction prior to needling, it is felt that a portion of the fibers oriented in the fill direction are partially twisted or reoriented in the warp direction so as to provide the increase in dimensional stability of the inventive fabric in the warp direction. This theory also accounts for the decrease in dimensional stability of the inventive fabric in the fill direction as fewer fibers are oriented in the fill direction after the stretching operation.

One of the more significant advantages of the present invention is that the traversal rate or speed of the lapper apron can be substantially reduced without a corresponding decrease in production. Also in the production of very light fabrics, web weighs can be maintained sufficiently high so as to preclude doffing problems encountered with some prior art processes.

As an example of the reduction in lapper apron speed, using the process shown in FIGS. 1 and 2 without the batt stretching or drafting step ad using polyester warp threads, a lapper apron speed of approximately 250 feet per minute was used to produce fabric at the rate of 27 feet per minute. Making the same weight product using the inventive process illustrated in FIGS. 1 and 2, a lapper apron speed of 100 feet a minute was used which resulted in a product rate of 34 feet per minute. Thus use of the present invention not only increases production but permits the slower operation of high maintenance equipment.

In general, the widths of the fabrics produced according to the invention vary widely; however the invention is particularly applicable for the production of wide nonwoven fabrics, that is, fabrics having a width ranging from about 108 to 230 inches. Usually the fabrics weight at least from about ½-ounce per square yard. Most any staple and combinations of staple are suitable for use in the present invention including natural staple such as wool and synthetic staple as previously described.

EXAMPLE I

Two runs were made using 3 denier per filament, 4-inch polypropylene staple. In both runs the needle loom was operated with ⅝-inch needle penetration and 600 punches per square inch. Both sides of the fabric were fused using a temperature of the first and second fusion rolls at 310° F. and 295° F. respectively. The fabric was 1500 mm wide.

Run 1 was a non-invention run in which the batt was formed by laying webs of polypropylene staple on a bet of warp threads spaced ¼-inch apart and running parallel to the warp direction of the batt. The warp threads were polyester staple, 30 count.

Figure 4:
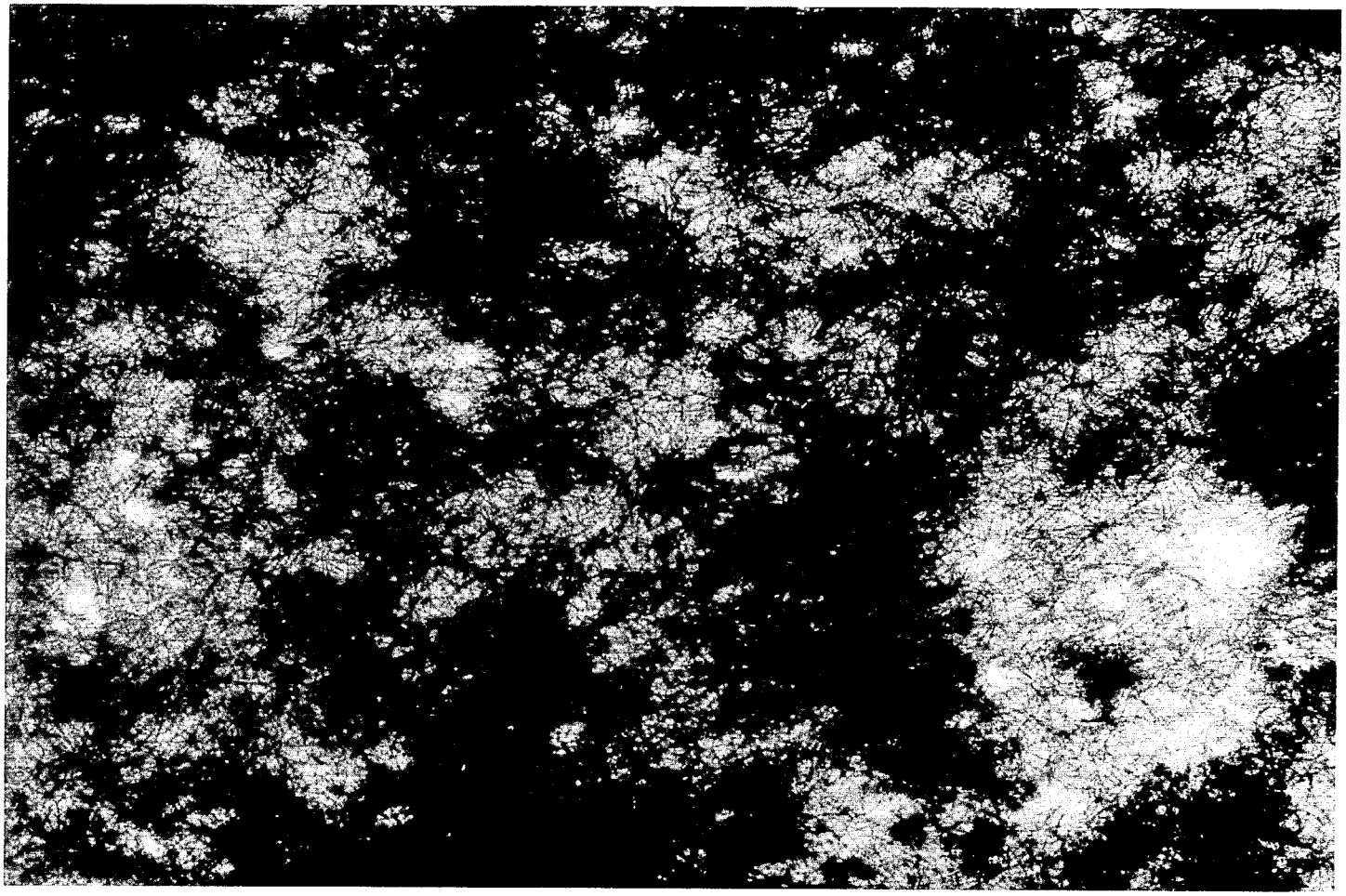
FIG. 4 is a photograph of the inventive nonwoven fabric produced according to the apparatus of FIGS. 1 and 2.

Run 2 was an inventive run, including a bonding step, using the process shown in FIGS. 1 and 2. Four stretching zones were used employing five sets of one-over-two nip rolls. A total draw ratio of 2 was used which was approximately equally divided across each of the four drafting zones. FIG. 4 is a photograph of the inventive fabric produced in Run 2.

Figure 3:
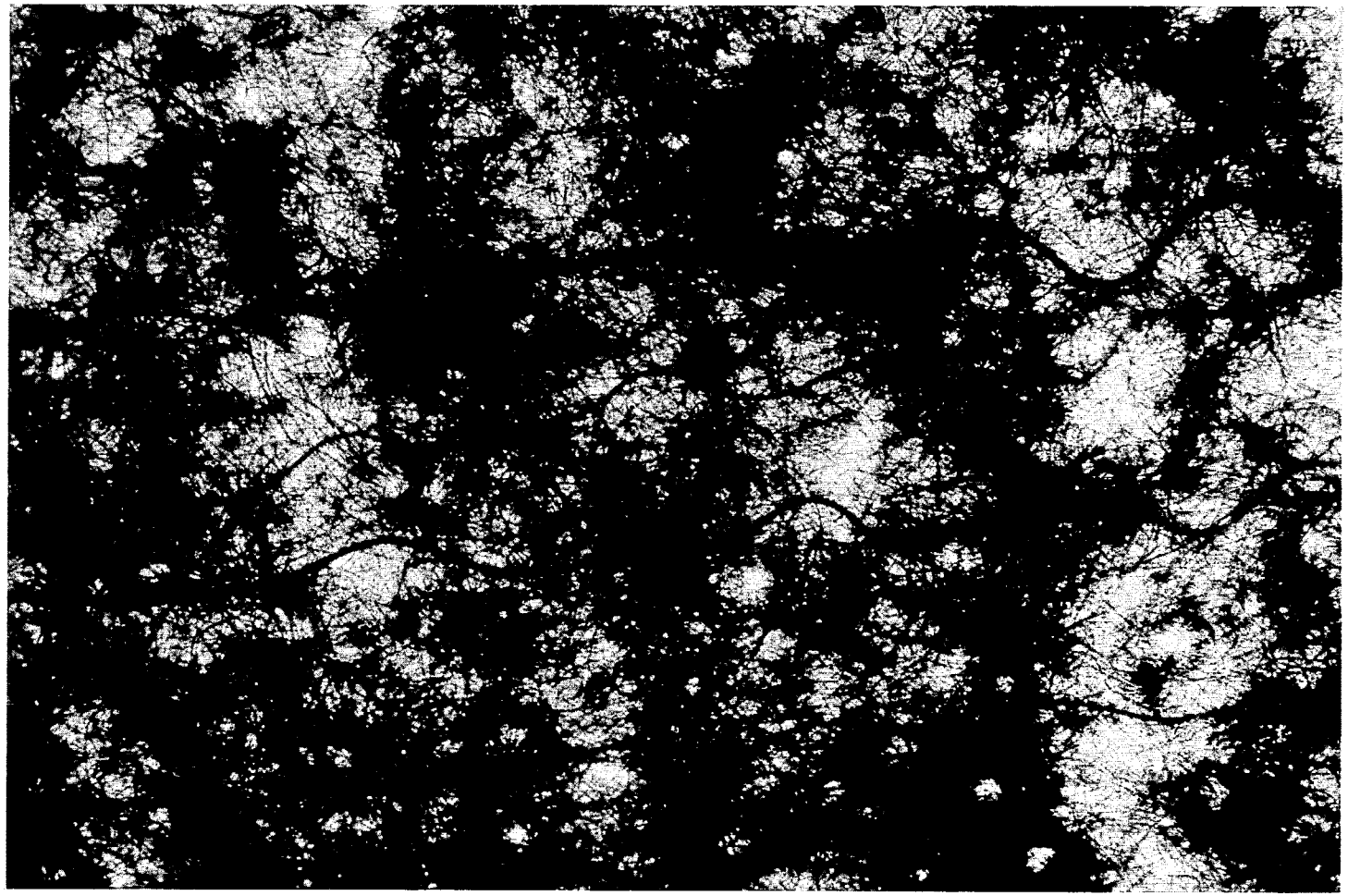
FIG. 3 is a photograph of a nonwoven fabric produced according to the prior art.

The process used for Run 1 was identical to that of Run 2 except that no drafting zones were used to stretch the batt and, as noted earlier, warp threads were used. FIG. 3 is a photograph of the fabric produced in Run 1. The results of the runs are shown in Table I below:

TABLE I

| | | Run 1 | Run 2 |
|---|---|---|---|
| Wt. oz/yd$^2$ | | 3.19 | 3.49 |
| Tear Strength, lbs. (ASTM D 2261-64T | | | |
| Warp Direction (W) | | 16.7 | 54.2 |
| Fill Direction (F) | | 23.0 | 57.0 |
| Breaking Strength, lbs. (ASTM D 1682-64) | | | |
| W | | 45 | 115 |
| F | | 76 | 185 |
| Elongation at 5 lbs., % (ASTM D 1682-64) | | | |
| W | | 6.6 | 3.3 |
| F | | 2.0 | 4.4 |
| Elongation at 20 lbs., % (ASTM D 1682-64) | | | |
| W | | 52.6 | 17.9 |
| F | | 15.9 | 21.9 |
| Ultimate Elongation, % (ASTM D 1682-64) | | | |
| W | | 110.4 | 70.4 |
| F | | 80.9 | 91.3 |
| Tear Strength at 3.5 oz/yd$^2$ (calculated | | | |
| W | from tear | 18.32 | 54.35 |
| F | strength data above) | 23.67 | 57.0 |
| Breaking strength at 3.5 oz/yd$^1$ (calculated | | | |
| W | from breaking | 49.37 | 115.32 |
| F | strength data above) | 78.24 | 185.0 |

Although the weight of the fabric of Run 2 was slightly higher than the weight of the fabric or Run 1, the properties of the fabric of Run 2 are much better than a simple weight increase of the fabric in Run 1 would provide. The percent elongation values are particularly noteworthy as illustrating the better overall dimensional stability of the inventive product. It is noted that the fabric of Run 1 showed better (lower) elongation values in the fill direction than the fabric of Run 2; however, the elongation values in the warp direction were much worse (higher) than those of Run 2. Also the fabric of Run 2 showed much better breaking strength (higher) than the fabric of Run 1. In view of all the data, the fabric of Run 2 is considered to have the better dimensional stability in both the warp and fill directions, and thus is preferred.

EXAMPLE II

Twelve additional runs were made using the same polypropylene staple and process as was used for Run 2. However, needle penetration, needling density and fusion temperature were varied. Also the fabric was 150 inches wide and weighed 3.2 ounces per square yard. The results are shown in Table II below:

TABLE II

| Run No. | Needle Penetration (inches) | Needling Density Punches in$^2$ | Fusion Temperature °F. Roll No. 1 / Roll No. 2 | Fused Fabric Properties - Not Tufted: Tear(1) Strength at 3.5 oz/yd$^2$ Warp | Tear(1) Strength Fill | Grab(2) Strength at 3.5 oz/yd$^2$ Warp | Grab(2) Strength Fill | Elongation at(2) 5 lbs. load % Warp | Elongation Fill | Elongation at(2) 20 lbs. load % Warp | Elongation Fill | Ultimate(2) Elongation % Warp | Ultimate Elongation Fill |
|---|---|---|---|---|---|---|---|---|---|---|---|---|---|
| 3 | ⅝ | 300 | Lo 310/295 | 26.5 | 38.1 | 75.0 | 12.1 | 1.4 | 2.2 | 14 | 16 | 96 | 95 |
| 4 | ⅝ | 300 | Hi 338/310 | 13.2 | 20.0 | 92.8 | 190 | 1.1 | 1.4 | 6.0 | 4.8 | 36 | 70 |
| 5 | ⅝ | 450 | Lo 310/295 | 39.3 | 45.7 | 100 | 123 | 1.2 | 1.9 | 6.8 | 15 | 56 | 79 |
| 6 | ⅝ | 450 | Hi 338/310 | 12.3 | 19.7 | 130 | 106 | 1.0 | 3.2 | 3.8 | 10 | 40 | 62 |
| 7 | ⅝ | 600 | Lo 310/295 | 30.4 | 43.8 | 101 | 115 | 1.7 | 2.6 | 7.0 | 19 | 61 | 84 |
| 8 | ⅝ | 600 | Hi 338/310 | 13.1 | 21.5 | 108 | 106 | 1.0 | 2.0 | 3.6 | 7.4 | 35 | 60 |
| 9 | ⅝ | 300 | Lo 310/295 | 33.2 | 47.9 | 102 | 106 | 2.2 | 3.8 | 13 | 32 | 61 | 111 |

TABLE II-continued

| Run No. | Needle Penetration (inches) | Needling Density Punches in² | Fusion Temperature °F. Roll No. 1 / Roll No. 2 | Fused Fabric Properties - Not Tufted: Tear(1) Strength at 3.5 oz/yd² Warp | Tear(1) Strength at 3.5 oz/yd² Fill | Grab(2) Strength at 3.5 oz/yd² Warp | Grab(2) Strength at 3.5 oz/yd² Fill | Elongation at(2) 5 lbs. load % Warp | Elongation at(2) 5 lbs. load % Fill | Elongation at(2) 20 lbs. load % Warp | Elongation at(2) 20 lbs. load % Fill | Ultimate(2) Elongation % Warp | Ultimate(2) Elongation % Fill |
|---|---|---|---|---|---|---|---|---|---|---|---|---|---|
| 10 | ⅝ | 300 | Hi 338/310 | 16.5 | 26.2 | 114 | 83.1 | 1.5 | 2.2 | 5.2 | 14 | 34 | 57 |
| 11 | ⅝ | 450 | Lo 310/295 | 32.8 | 47.9 | 107 | 126 | 1.9 | 2.3 | 8.1 | 13 | 76 | 80 |
| 12 | ⅝ | 450 | Hi 338/310 | 16.0 | 26.7 | 89.0 | 118 | 1.5 | 1.9 | 3.7 | 4.8 | 40 | 53 |
| 13 | ⅝ | 600 | Lo 310/295 | 38.5 | 31.6 | 107 | 131 | 1.2 | 1.9 | 7.6 | 13 | 68 | 82 |
| 14 | ⅝ | 600 | Hi 338/310 | 17.2 | 22.5 | 122 | 83.7 | 1.8 | 2.6 | 3.6 | 9.1 | 36 | 50 |

(1)ASTM D 2261-64T, values in table were calculated from values obtained by testing 3.2 oz/yd²
(2)ASTM D 1682-64, values in table were calculated from values obtained by testing 3.2 oz/yd² fabric It appears that the fabric produced in Run 5 had the best overall properties of dimensional stability and strength evidenced by percent elongation and tear strength respectively. However, all the runs produced a satisfactory product.

What is claimed is:

1. A method for the production of a nonwoven fabric comprising, in combination, the steps of:

(a) forming a batt comprising fibers oriented primarily transverse relative to the direction of movement of said batt;

(b) reorienting said fibers toward the longitudinal direction relative to the direction of movement of said batt by employing at least two sets of nip rolls operated in series to form a drafting zone wherein each set of nip rolls traverses the batt and wherein each set of nip rolls is operated at a higher speed than the preceding set of nip rolls and without the use of pin bars, thereby stretching said batt longitudinally relative to the direction of movement of said batt; and (c) needling said stretched batt.

2. The method of claim 1 wherein said batt is formed by crosslapping webs.

3. The method of claim 1 wherein the batt is evenly stretched by employing an inlet apron followed by at least one set of nip rolls wherein the inlet apron and nip rolls traverse the batt and each successive set of nip rolls is operated at a higher speed than the speed of the preceding inlet apron or nip rolls, thus stretching the batt.

4. The method of claim 1 wherein the batt is stretched employing a drafting ratio ranging from about 1.1 to 3, a number of drafting zones ranging from about 2 to 6, and a maximum drafting ratio per drafting zone of about 2.0.

5. The method of claim 1 wherein the batt is stretched employing a drafting ratio ranging from about 1.4 to 2.1, a number of drafting zones ranging from about 3 to 5, and a maximum draft ratio per drafting zone of about 1.5.

6. The method of claim 1 wherein the needling penetration is in the range from about ¼-inch to ¾-inch and the needling density is in a range of from about 300 to 600 punches per square inch.

7. The method of claim 1 further comprising the step of bonding a portion of the fibers to each other at least on one side of the needled batt.

8. The method of claim 7 wherein the fibers comprise synthetic fibers.

9. The method of claim 8 wherein the synthetic fibers are bonded by fusing said fibers together.

10. The method of claim 8 wherein the synthetic fibers are selected from the group consisting of polyolefin, polyester or polyamide.

11. The method of claim 10 wherein the polyolefin is polypropylene.

12. The method of claim 11 wherein the polypropylene fibers are crimped.

13. The method of claim 11 wherein said fusing is accomplished by passing said needled batt over two heated rolls, the first roll being at a temperature in the range of from about 310° to 338° F. and the second roll being at a temperature in the range of from about 300° to 320° F.

14. The method of claim 13 wherein said first roll is at a temperature in the range of from about 320° to 325° F. and the second roll is at a temperature in the range of from about 310° to 315° F.

15. The method of claim 11 wherein the fibers range from about 1.5 to 60 denier and from about 1.5 to 10 inches in length, and the nonwoven fabric weighs at least about ½ ounce per square yard and ranges from about 108 to 230 inches in width.

16. A nonwoven fabric produced in accordance with the method of claim 1.

17. The fabric of claim 16 wherein the batt is sufficiently stretched so as to substantially increase the dimensional stability of fabric in the warp direction as compared to fabric produced without stretching the batt.

18. The fabric of claim 16 wherein the fibers are polyolefin fibers.

19. The fabric of claim 18 wherein the polyolefin is polypropylene, the denier of the fibers ranges from about 1.5 to 60, the length of the fibers ranges from about 1.5 to 10 inches, the weight of the fabric is at least about ½ ounce per square yard, and the width of the fabric ranges from about 108 to 230 inches.

20. The fabric of claim 19 wherein the fibers on at least one surface of said fabric are fused together.

21. Apparatus comprising, in combination:

(a) at least one crosslapper for laying a web of fibers to produce a batt wherein the fibers are oriented primarily transverse relative to the direction of movement of the batt;

(b) a carrier means to receive the web of fibers and transport the batt;

(c) a batt stretching means operated to reorient said fibers toward the longitudinal direction relative to the direction of movement of said batt and in the absence of needle bars solely by stretching said batt longitudinally relative to the direction of movement of said butt; and (d) a needle loom positioned to needle punch the stretched batt.

22. The apparatus of claim 21 further comprising bonding means for bonding the fibers of at least one surface of said needled batt.

23. The apparatus of claim 21 wherein said batt stretching means comprises an inlet apron and at least one set of nip rolls.

24. The apparatus of claim 21 wherein said batt stretching means comprises at least two sets of nip rolls.

25. The apparatus of claim 21 wherein said batt stretching means comprises an inlet apron and five sets of nip rolls.

26. The apparatus of claim 22 wherein said bonding means is at least one heated roll for fusing said fibers together and said carrier means is a floor apron.

27. The apparatus of claim 21 including a carding machine to form said web of fibers and means for feeding fibers to said carding machine.

* * * * *